US006823929B2

(12) United States Patent
Kaneto et al.

(10) Patent No.: US 6,823,929 B2
(45) Date of Patent: Nov. 30, 2004

(54) DIE MOLDING MACHINE AND PATTERN CARRIER

(75) Inventors: Kimikazu Kaneto, Toyokawa (JP); Minoru Hirata, Toyokawa (JP); Yutaka Hadano, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 149 days.

(21) Appl. No.: 10/018,569

(22) PCT Filed: Apr. 17, 2001

(86) PCT No.: PCT/JP01/03262

§ 371 (c)(1),
(2), (4) Date: Dec. 20, 2001

(87) PCT Pub. No.: WO01/81025

PCT Pub. Date: Nov. 1, 2001

(65) Prior Publication Data

US 2003/0098137 A1 May 29, 2003

(30) Foreign Application Priority Data

| | | |
|---|---|---|
| Apr. 21, 2000 | (JP) | 2000-120567 |
| May 19, 2000 | (JP) | 2000-148123 |
| Jun. 8, 2000 | (JP) | 2000-171684 |

(51) Int. Cl.[7] ..... B22C 7/04

(52) U.S. Cl. ..... 164/239; 164/237; 164/172; 164/200

(58) Field of Search ..... 164/37, 172, 195, 164/200, 201, 202, 207, 239, 237

(56) References Cited

U.S. PATENT DOCUMENTS

| | | | | |
|---|---|---|---|---|
| 3,736,978 A | * | 6/1973 | Taccone | 164/187 |
| 4,230,172 A | * | 10/1980 | Uzaki et al. | 164/192 |
| 4,702,301 A | | 10/1987 | Bühler | 164/168 |

FOREIGN PATENT DOCUMENTS

| | | | |
|---|---|---|---|
| DE | 3437702 C1 | | 6/1985 |
| JP | 58-53349 | * | 3/1983 |

* cited by examiner

*Primary Examiner*—Kiley Stoner
*Assistant Examiner*—Len Tran
(74) *Attorney, Agent, or Firm*—Finnegan, Henderson, Farabow, Garrett & Dunner L.L.P.

(57) ABSTRACT

A pattern carrier for a flask molding machine including a mount on which a pattern plate is mounted and a flask-shaped, molding flask-removing frame adapted to make contact with a lower end of a molding flask of a flask molding machine and moveable up and down around said pattern plate for removing a finished mold.

6 Claims, 11 Drawing Sheets

DIE MOLDING MACHINE AND PATTERN CARRIER

TECHNICAL FIELD

This invention relates to a method and apparatus for compressing foundry sand in a molding space. It also relates to a molding machine equipped with a flask and a pattern carrier, wherein upper and lower mold halves are alternately molded for each empty mold half carried therein. In particular, it relates to improvement in the pattern plate carrier with an auxiliary flask carried along with a pattern plate.

BACKGROUND OF THE INVENTION

Conventionally, foundry sand has been compressed in a molding space formed between a pattern plate and molding flask by having the pattern plate and compressing means approach each other. This method has some problems in that since it needs large-sized cylinders the height of a molding machine used for them becomes high and the related facilities, such as a pit, cost a lot accordingly. This method has also some disadvantages in that since in it, wherein an auxiliary flask on which a molding flask is put is put on the upper part of a pattern plate, the foundry sand thrown into the molding space to fill it must be smoothed prior to compression, so that a lot of spilled sand may be generated, and so that uneven compression or an uneven compressed surface may occur. Therefore, a lot of time and labor are needed to deal with such disadvantages. Further, in the conventional blow-squeeze machine, wherein foundry sand is blown into a molding space to fill the space defined by squeeze heads, a molding flask on which an auxiliary flask is put, and a pattern plate, the foundry sand is squeeze compressed.

Japanese Patent Early publication No. 63-63552 discloses a pattern plate carrier with an auxiliary flask as an example used in such a blow squeeze machine. In the conventional pattern plate carrier with an auxiliary flask, a pattern plate is mounted on a carrier box disposed movably up and down such that the auxiliary flask is moved up and down through cylinders fixed to the carrier box. Since to move the auxiliary flask of the thus constituted conventional pattern plate carrier large sized air cylinders having a large diameter are used, a great space is needed as well as a large sized, high priced blow squeeze machine. Further, there is also a problem in that to remove the piping of the air cylinder the replacement of the pattern plate carrier with an auxiliary flask is very troublesome.

DISCLOSURE OF INVENTION

In view of these circumstances this invention was made. Thus, one object of this invention is to supply a method and apparatus for molding foundry sand into a mold with a given uniform hardness in a molding space defined by a pattern plate and flask members without using a pit or large sized oil cylinders.

Another object of this invention is to supply a molding machine and pattern carrier wherein the generation of spills or scraps of sand is reduced, and wherein foundry sand is homogenously compressed at a low cost.

A further object of this invention is to supply a compact pattern plate carrier with an auxiliary flask that can be easily replaced.

In accordance with one aspect, the method of this invention for molding a mold by compressing foundry sand disposed in a molding space defined by a pattern plate, subsidiary flask, and flask member comprises the steps of throwing foundry sand into the molding space, pressing down the foundry sand in the molding space while at least said subsidiary flask is being kept unable to go downward, and further pressing down the foundry sand in the molding space while both said subsidiary flask and said flask members are being kept unable to go downward.

In accordance with a further aspect, the apparatus of this invention for molding a mold comprises a pattern plate fixedly disposed horizontally, a subsidiary flask disposed around said pattern plate so as to be moved up and down, lift means for moving said subsidiary flask up and down, a flask member disposed above said subsidiary flask so as to be moved up and down, and compressing means disposed above said flask member wherein the ends of the compressing members can reach at least a point within said flask member.

In another aspect, the apparatus of this invention for molding a mold comprises a pattern plate disposed fixedly and horizontally, a subsidiary flask disposed around said pattern plate so as to be moved up and down, lift means for moving said subsidiary flask up and down, a flask member disposed above said subsidiary flask so as to be moved up and down, and compressing means disposed above said flask member, wherein the ends of the compressing members can reach at least a point within said flask member.

In still another aspect, the pattern carrier of this invention comprises a mount on which the pattern plate is mounted and a flask-shaped frame disposed to be movable up and down around said pattern plate for removing a finished mold.

In a further aspect, the pattern carrier of this invention comprises a mount on which a pattern plate is mounted, a flask-shaped frame disposed to be movable up and down around said pattern plate for removing a finished mold, a plurality of guide pins for moving said flask-shaped frame up in a parallel manner, and a plurality of actuators mounted on a molding.

In a still further aspect, the pattern plate carrier of this invention for carrying a pattern plate comprises a plurality of upwardly movable cylinders mounted on said pattern plate carrier to move said auxiliary flask, at least two special oil cylinders mounted on said pattern plate carrier for supplying fluid to the upward cylinders by being alternately contracted, and at least two cylinders disposed separately outside said pattern plate carrier and constituted such that the alternate expansion of said at least two cylinders causes said special oil cylinders to alternately contract.

BRIEF DESCRIPTIONS OF DRAWINGS

PREFERRED EMBODIMENTS OF INVENTION

Figure 1:
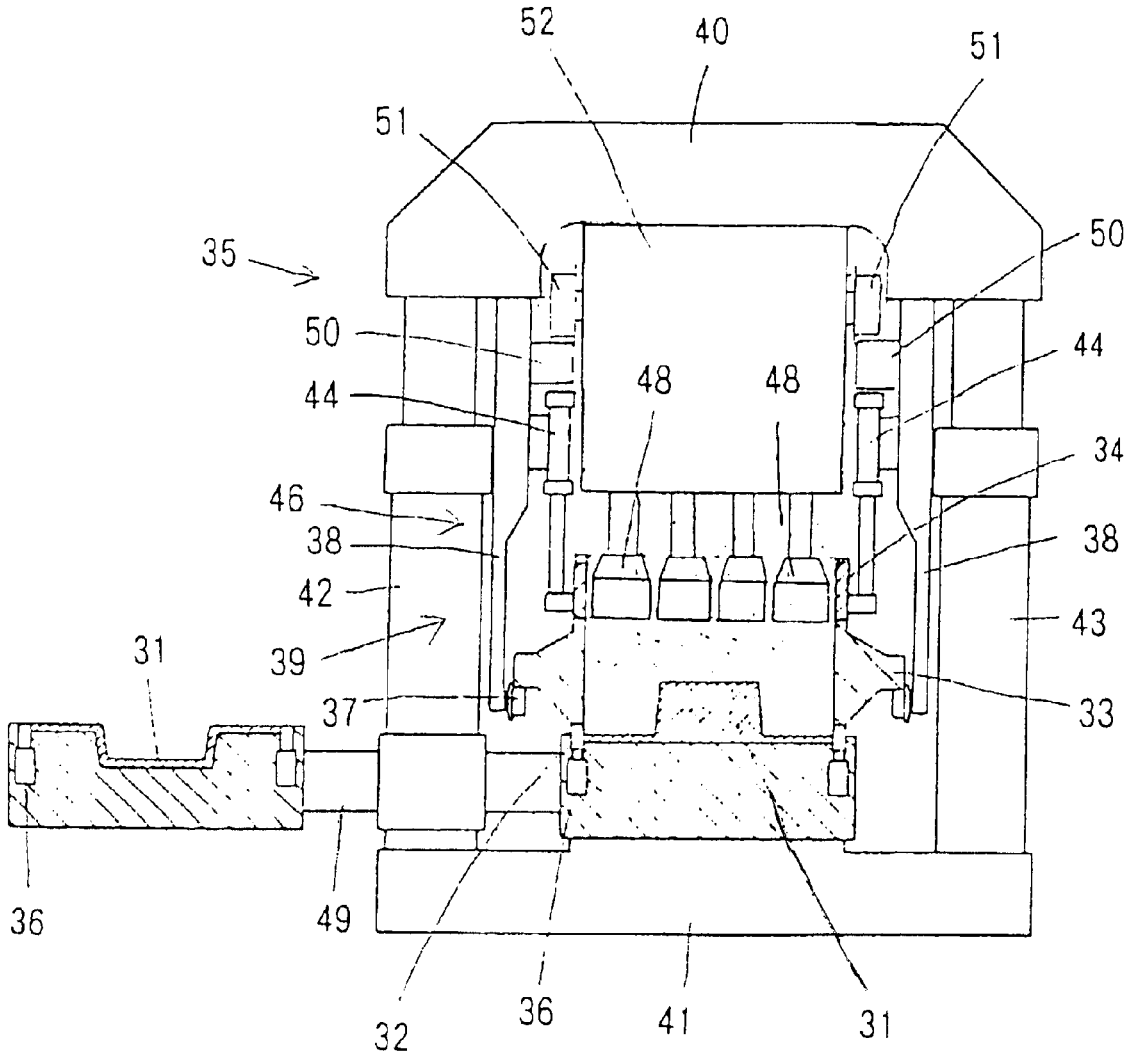
FIG. 1 is a schematic vertical section to show a first embodiment of the molding machine of this invention.

Referring to FIG. 1, now we explain a first embodiment of the molding machine of this invention. The molding machine comprises a pattern plate 31 fixed horizontally, a lower subsidiary flask 32 that surrounds the periphery of the pattern plate 31 and that is disposed such that it can be both slid and moved up and down, a molding flask 33 that is disposed above the lower subsidiary flask 32 so as to be moved up and down, an upper subsidiary flask 34 disposed above the molding flask 33 so as to be moved up and down, and the squeeze feet 48 of the compressing means 35, which are disposed so as to be movable up and down above the molding flask 33 such that their ends can reach within an area surrounded by the upper subsidiary flask 34.

The pattern plate 31 is mounted on the upper surface of a turntable 49, described below. In the upper surface of the pattern plate 31, vent-plugs (not shown) are embedded according to the shape of the pattern plate. The lower subsidiary flask 32, mounted on the turntable 49, is moved up and down by oil cylinders 36,36 that are installed in the turntable as a lift mechanism for the lower flask. The molding flask 33 is moved in the front and rear directions (in relation to the face of the drawing) by a transport mechanism 39 installed in a lift frame 40 that is pivoted onto frames 38,38 through a plurality of rollers 37,37 with collars. The rollers 33,37 are distanced also in the front and rear directions. The lift frame 40 bridges the upper ends of the piston rods of two oil cylinders 42,42 that are installed in the left and right ends of a level block like base, and is moved up and down by the expansion/contraction of the oil cylinders.

The upper subsidiary flask 34 bridges the lower ends of the piston rods of downward oil cylinders 44,44 installed in the frames 38,38 The compressing means 35, having squeeze feet 48,48, namely, a plurality of compressing members in a square shape, are mounted on rails 50,50 that are installed in the frames 38,38 such that the compressing feet can be moved in the front and rear directions through a plurality of rollers 51,51 with collars. A hopper 52 is mounted on the rails 50,50 so that the hopper can be moved in the front and rear directions. The central part of the turntable 49 is installed in the left-side oil cylinder 42 as transport means for transporting the pattern plate in the left and right directions such that the turntable can be intermittently and horizontally rotated.

Below we explain the procedure for compressing foundry sand thrown into a given molding space. First, the lower subsidiary flask 32 is moved up by expanding the oil cylinders 36,36; in this state the oil cylinders 42,43 are contracted by a given length; the lift frame 40 is moved down so that the molding flask 33 is put on the lower subsidiary flask 32; and then the oil cylinders 44,44 are expanded such that the upper subsidiary flask 34 is put on the molding flask 33 to form a molding space.

After the formation of the molding space, a given amount of molding sand is thrown into the molding space from the measuring hopper 52; the hopper 52 is then transported out and at the same time as this the compressing means 35 are transported above the upper subsidiary flask 34. The downward movement of the lower subsidiary flask 32 is then caused to be unable to be further continued by stopping the discharge of oil when the oil cylinders 36,36 are being contracted; the compressing members 48,48 of the compressing means 35 are independently moved down while the discharge side of the oil in the cylinders has been released when the oil cylinders 44,44 are being contracted; and the compressing means 35 are then moved down by an appropriate height through the lift frame 40 by contracting the oil cylinders 42,43 so that the foundry sand is compressed, to thus complete the first stage of the compression.

Next, the downward movement of the lower subsidiary flask 32 is made possible by releasing the discharging side of the oil cylinders 36,36 when the cylinders are being contracted; the compressing means 35, molding flask 33, and upper subsidiary flask 34 are then moved down by further contracting the oil cylinders 42,43; and then the lower subsidiary flask 32 is thereby moved down through the molding flask 33, upper subsidiary flask 34, and oil cylinders 44,44 such that the foundry sand united with the molding flask 33 is moved down to be further pressed against the pattern plate, to thus complete the second stage of compression, At this time, preferably the lower surface, namely the joint surface of the foundry sand in the molding flask, coincides with the level of the lower surface of the molding flask.

One cycle of the process of pressing foundry sand is then completed as follows: after the foundry sand has been compressed, the compressing leans 35, including the compressing members 48,48 or the like and the upper subsidiary flask 34 and the like are moved upward by operating the oil cylinders 42,43 in an expansion mode while also operating the oil cylinders 36,36 in an expansion mode; the molding flask 33, having a finished mold therein, is raised by being hung up by rollers 37,37, each having a collar, so as to be separated from the pattern plate 31; another pattern plate 31 is then brought just under the compressing means 35 by horizontally rotating the turntable 49 by 180 degrees; the measuring hopper 52 is filled by foundry sand; and finally, another empty molding flask 33 is put on the transport mechanism 39 to complete the cycle.

Although in the above embodiment a mold with a molding flask is used, a mold with no flask that has just been pushed out from a molding mold may also be used. In this case, the pressing members 48,48 can be moved down to any level within the upper subsidiary flask 34 and molding flask, and further, the upper subsidiary flask 34 can be omitted.

Now we explain a second embodiment of this invention by referring to FIGS. 2–10.

Figure 2:
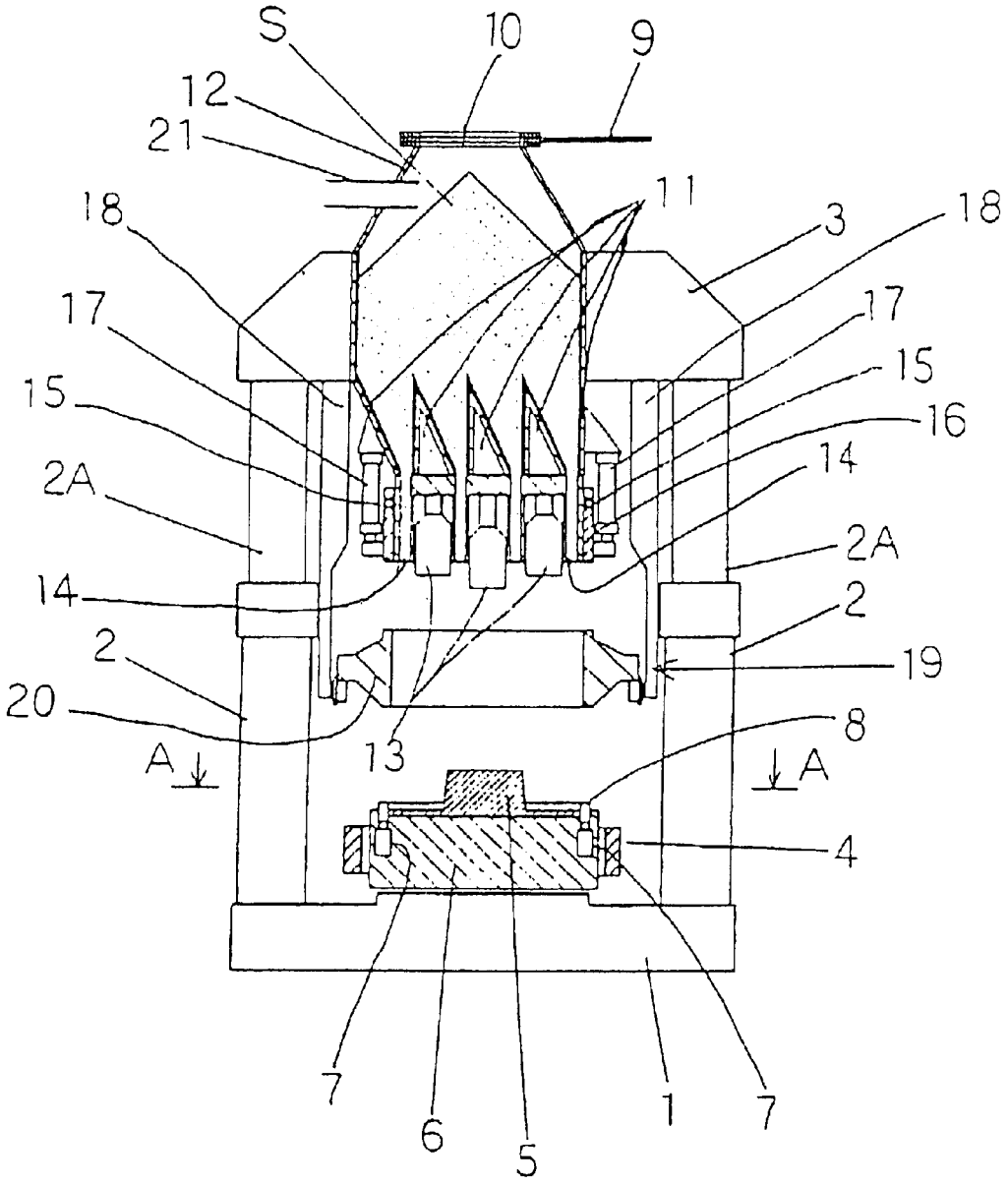
FIG. 2 is a schematic vertical section to show a state of standby for operating a second embodiment of the molding machine of this invention.
Figure 3:
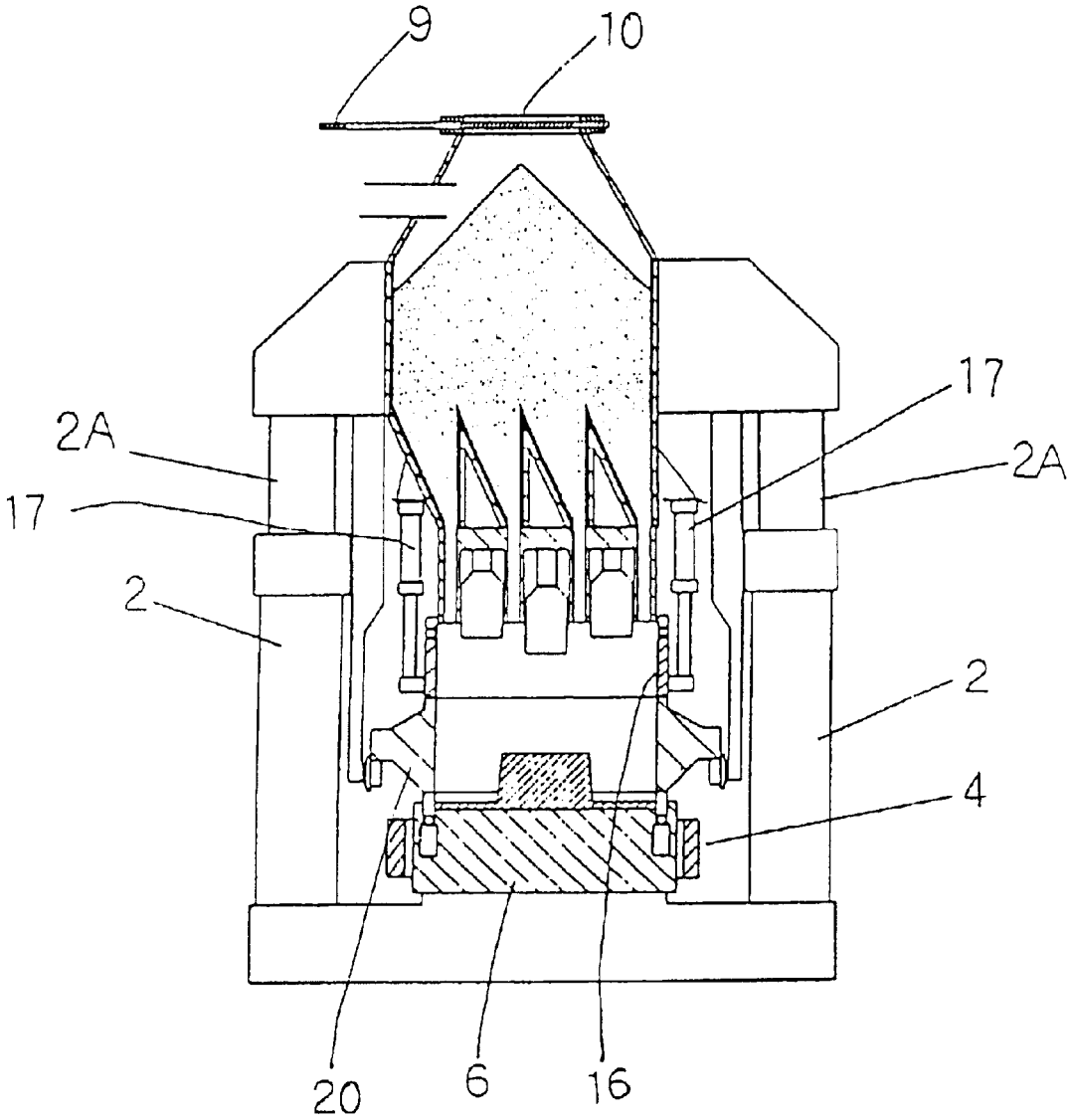
FIG. 3 is a schematic vertical section to show a state of a molding space being defined in the embodiment of FIG. 2.

In FIG. 2, upward flask-setting cylinders 2,2 are mounted on a molding base 1, and a frame 3 for supporting the lifting movement of molding members bridges the rods 2A,2A of the cylinders 2,2. A pattern-replacing device 4 for alternatively transporting a pattern carrier 6,6A (see FIG. 9), on which a pattern plate 5,5A is to be mounted, is disposed above the molding base 1 in a direction perpendicular to the left and right directions of the flask-setting cylinders 2,2. The pattern-replacing device 4 is disposed so as to be movable perpendicular to the face of the drawing by an actuator (not shown).

Figure 9:
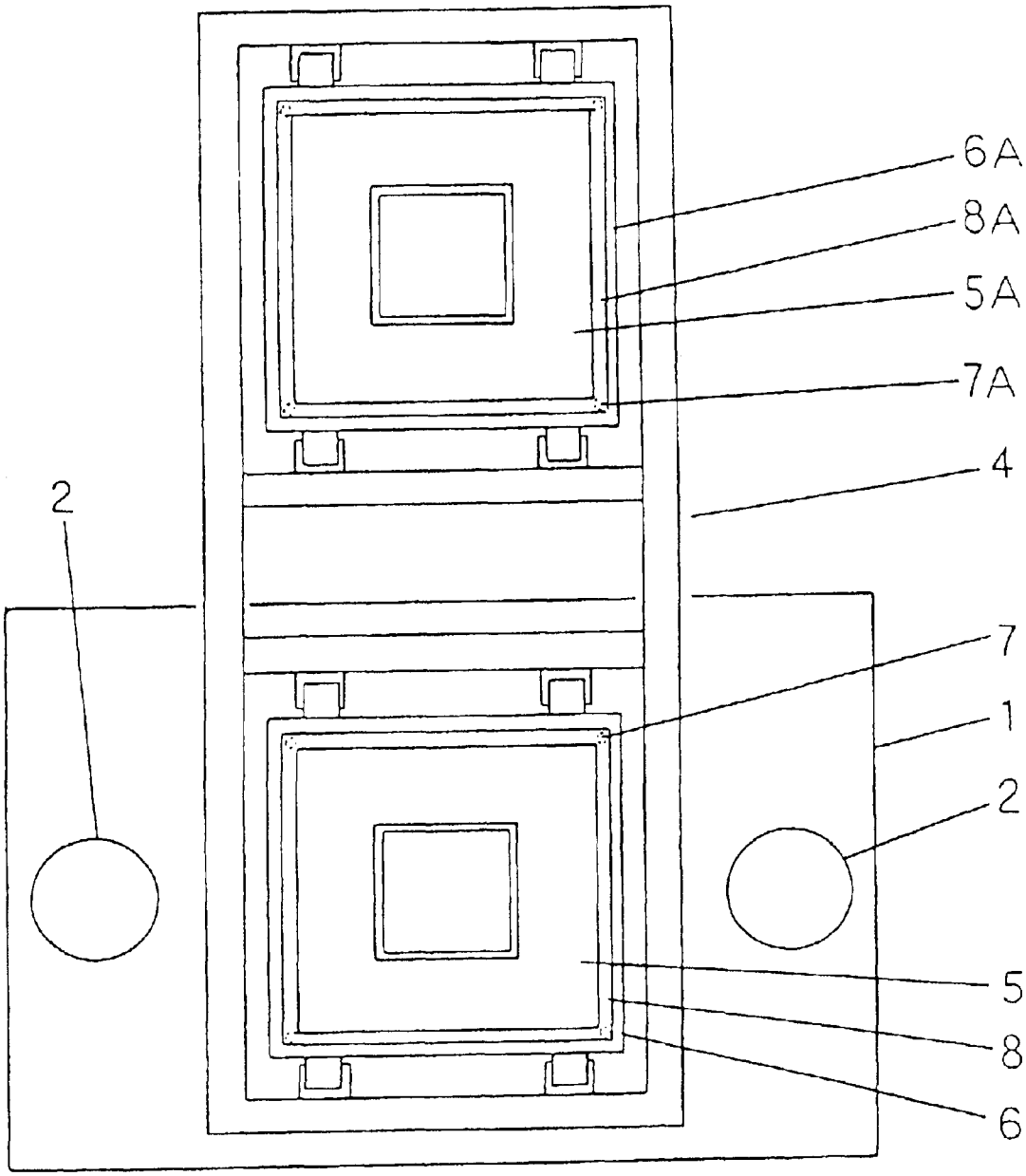
FIG. 9 is an enlarged section viewed from an arrowed line A—A in the embodiment of FIG. 2.

A pattern carrier 6,6A, on which a pattern plate 5,5A (an upper and lower pattern plates) is to be mounted; is mounted on both sides of the pattern-replacing device 4 such that the pattern carrier 6,6A is in a raised state by about 5 mm through a spring (not shown), and such that the pattern plate 5,5A is alternatively transported into and out relative to a position just above the center of the molding base 1 (see FIG. 9).

Flask-removing upward cylinders 7,7A, operating as an actuator, are embedded in the four corners of the outside of the pattern plate 5,5A on the pattern carrier 6,6A. Flask-shaped flask-removing frames 8,8A are connected to and supported by the ends of the cylinders 7,7A such that the frames 8,8A can be freely moved up and down while surrounding the pattern plate 5,5A. The flask-removing frames 8,8A are constituted such that at the expanded end of the flask-removing cylinders 7,7A the frames 8,8A protrude a little above the parting plane of the pattern plate 5,5A, and at the contracted end the frames are almost level with the parting plane (see FIG. 6).

A sand hopper 12 is hung from the support frame 3. An opening 10, through which foundry sand is thrown into the hopper, and which is opened and closed by a slide gate 9, is provided in the upper end of the hopper, and numbers of air chambers 11,11 are provided in the inside of the hopper 12. An air supply tube 21, through which low-pressure air (for example, 0.05–0.18 Mpa) is introduced communicates with the upper part of the hopper 12 via a changeover valve (not shown) An aeration mechanism is provided in the inside of the lower part of the hopper wherein the air chambers 11,11 communicate with a low-pressure ail source (for example, 0,05–0.18 Mpa) via a changeover valve (not shown) such that the low-pressure air is jetted into the hopper 12 to aerate and fluidize the foundry sand S. Further, in the bottom of the hopper 12 segmented-squeeze feet (compressing members) 13,13 are provided, and around them nozzles 14,14 are provided to direct the sand for filling the hopper.

A subsidiary flask 16 is disposed to surround the segment-squeeze feet 13,13 and sand nozzles 14,14. The subsidiary flask 16 is moved up and down through downward subsidiary flask cylinders 17,17 installed in the lower part of the hopper 12. In the upper part of the subsidiary flask 16 vent holes 15,15 that communicate with a control chamber (not shown) are disposed to control exhaust air. A transport conveyor 19 for a molding flask 20 is hung from frames 18,18 extending, in both the left and right sides of the sand hopper 12, from the lift frame 3 to the lower part of the squeeze feet 13,13.

Referring again to FIGS. 2–10, now we explain the details of the operation of the molding machine of this invention.

In FIG. 2; foundry sand is thrown into the sand hopper 12, all segmented-squeeze feet 13,13 together form a concave/convex shape corresponding to that of the pattern plate 5, and an empty molding flask 20 is post on the transport conveyor 19.

The pattern carrier 6 is set on the pattern replacing device 4 in a raised state, about 5 mm above the molding base 1. The mold removing frame 8 is made to protrude above the parting plane of the pattern plate 5 by the subsidiary flask cylinders 7,7. In this state, the subsidiary flask 16 is moved down to closely contact the upper surface of the molding flask 20 by expanding the subsidiary cylinders 17,17 after the sand throwing opening has been closed by the slide gate 9; the molding flask 20 is then pressed against the protruding mold removing frame 8 at the periphery of the pattern plate 5 through the contraction movement of the flask-setting cylinders 2,2; and the pattern carrier 6 is then pushed down in resistance to a spring (not shown), to thus achieve the state as in FIG. 3. At this time the molding space formed by the pattern plate 5, mold removing frame 8, molding flask 20, subsidiary flask 16, and squeeze feet 13,13 takes a concave/convex shape corresponding to the concave/convex shape of the pattern plate 5.

Figure 4:
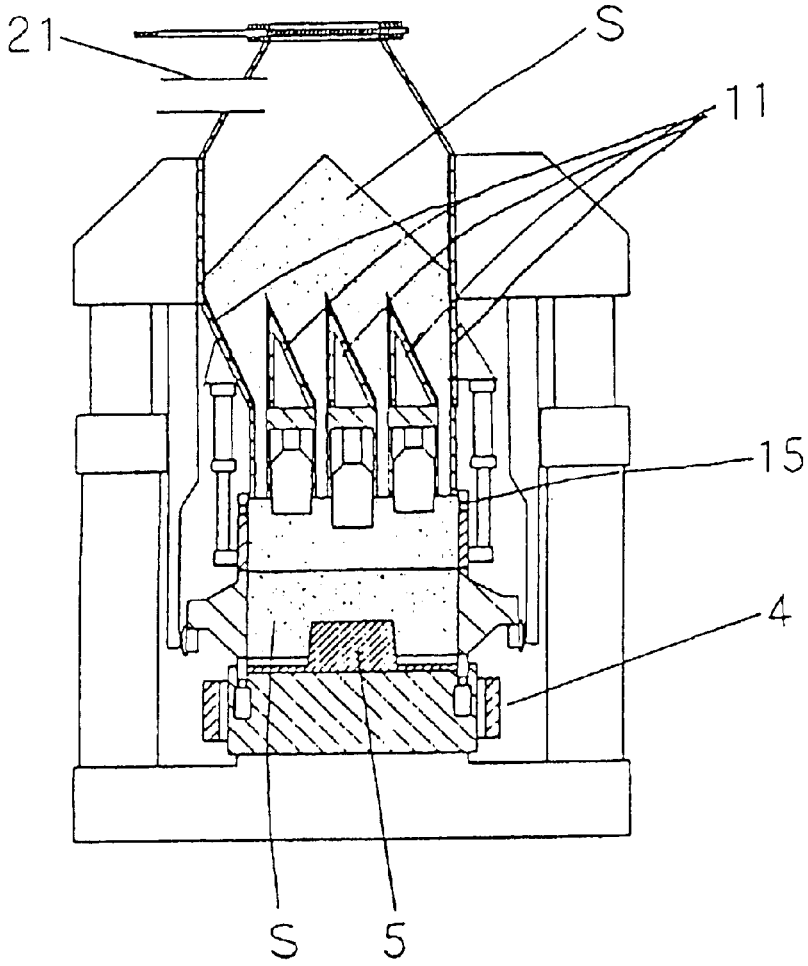
FIG. 4 is a schematic vertical section to show a state of the molding space being aeration filled with foundry sand in the embodiment of FIG. 2.

The state as in FIG. 4 is then achieved as follows: low-pressure air is supplied to the sand hopper 12 from the air supply tube 21 via a changeover valve (not shown) while the foundry sand S in the hopper being aerated by low-pressure air is jetted thereinto from numbers of air jet chambers 11,11; and the molding space is thus aeration filled with the foundry sand through the sand directing nozzles 14,14, as shown in FIG. 4. At this time the remaining low-pressure air used for the aeration filling is discharged through vent holes 15 (not shown) of the pattern plate 5. Further, the. amount of exhaust air discharged from the vent holes 15 (not shown) of the pattern plate 5 can be controlled by controlling the exhaust air by using an exhaust air control chamber (not shown). This may enable the density of the foundry sand to be partly adjusted to fill a complicated shape of the pattern plate 5 in the molding space.

Figure 5:
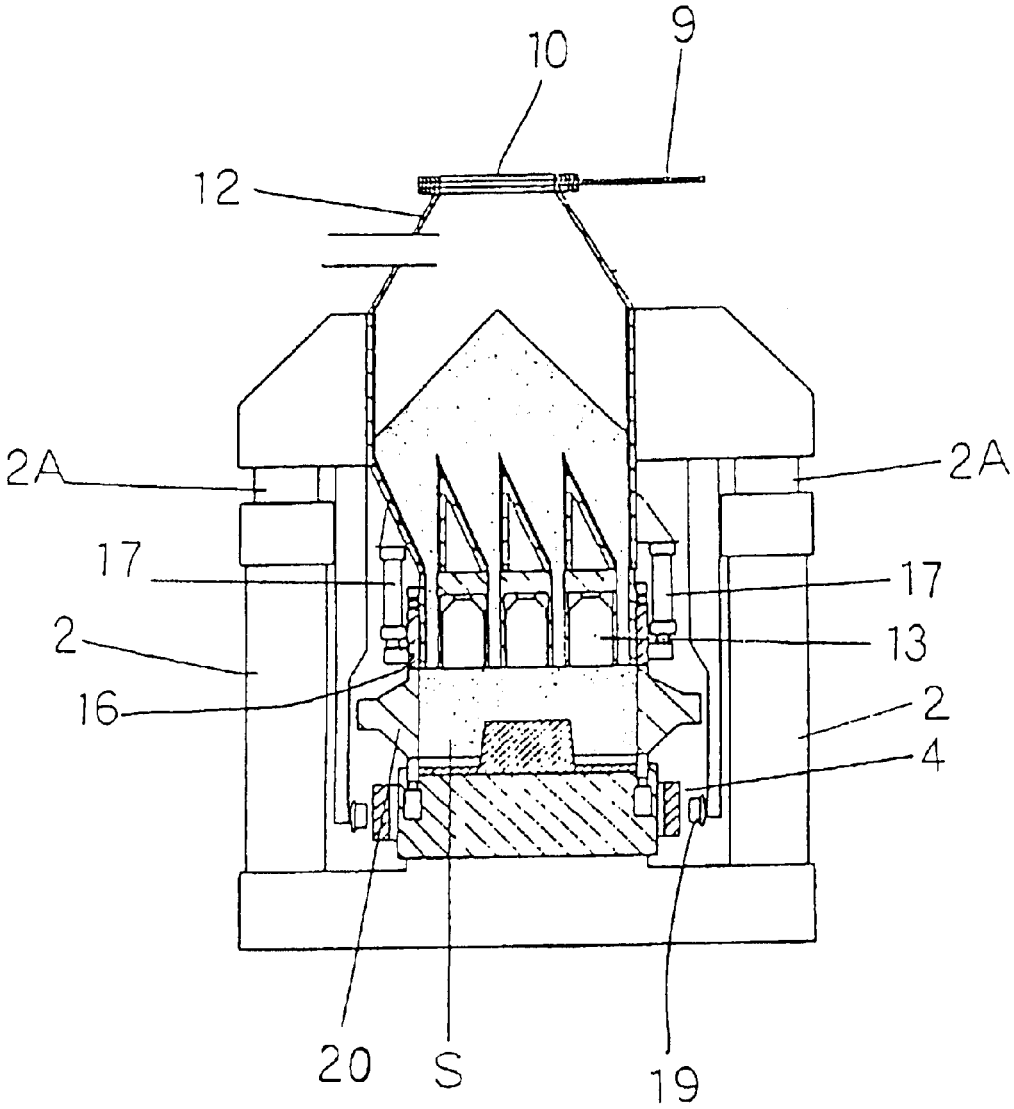
FIG. 5 is a schematic vertical section to show a state of the foundry sand being primarily compressed in the embodiment of FIG. 2.

The state as in FIG. 5 is then achieved as follows: the lift support frame 3 and the members supported by it are moved down further while the flask-setting cylinders 2,2 are being further contracted, and while the subsidiary flask cylinders 17,17 are also being contracted; and then the primary squeeze, namely, the first step compression, is carried out until all the lower surfaces of the squeeze feet 13,13 become flat, as shown in FIG. 5. At this time the contraction movement of the flask-setting cylinders 2,2 is continued until the compression (squeeze) pressure indicated by a pressure sensor (not shown) has reached a given first set pressure or the position of an encoder (not shown) of the flask-setting cylinders 2,2 has reached a given first set position.

Figure 6:
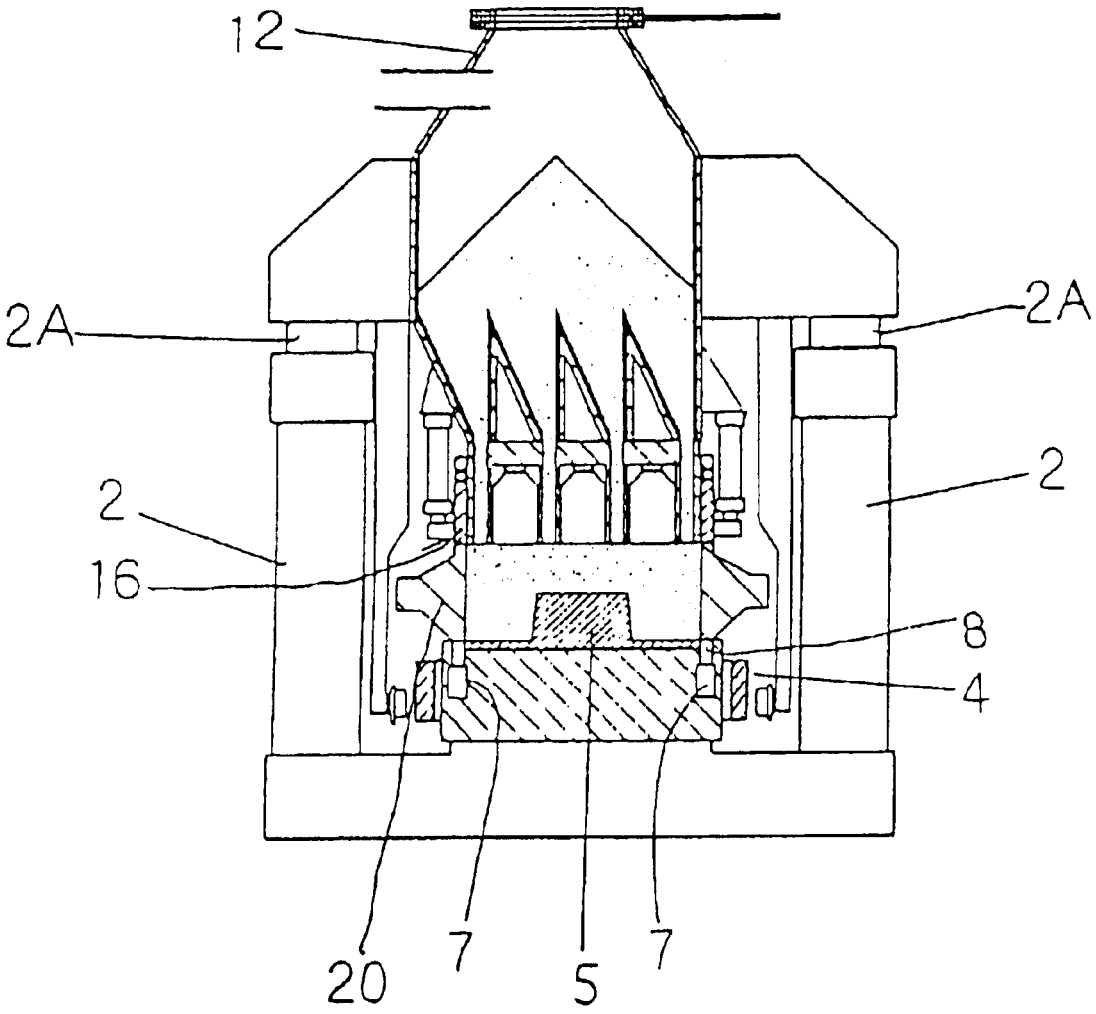
FIG. 6 is a schematic vertical section to show a state of the foundry sand being secondarily compressed in the embodiment of FIG. 2.

The state as in FIG. 6 is then achieved as follows: the flask-removing cylinders 7,7 are caused to be changed into an oil released state and at the same time as this the flask-setting cylinders 2,2 are contracted at a pressure higher than the first step pressure such that the molding flask 20, subsidiary flask 16, and squeeze feet 13,13 are moved down as a unit to secondarily squeeze (second compression) all the foundry sand. Thus, the mold removing frame 8 is moved down by the contraction of the flask-removing cylinders 7,7 to a level about the same as that of the parting plane of the pattern plate 5, as shown in FIG. 6. Further, in a case where the squeeze pressure does not reach the given second pressure when the mold removing frame 8 has reached the end of the downward movement, a further squeeze is carried out by further contracting the flask-setting cylinders 2,2 while the subsidiary flask cylinders 17,17 are being contracted.

When the squeeze pressure has reached the given second set pressure, a squeeze-stabilizing timer begins to operate so that the squeeze operation is maintained for a given time. At this time, to correspond to the situation wherein the mold removing frame 8 has not reached the end of the downward movement, the subsidiary flask cylinders 17,17 are operated in an expansion mode such that the molding flask 20 is pushed down until the to mold removing frame 8 has reached the end of the downward movement through the downward movement of the subsidiary flask 16. Thus, the lower surface of the molding flask 20 can be kept at about the same height as the lower surface of the mold at each time.

Figure 7:
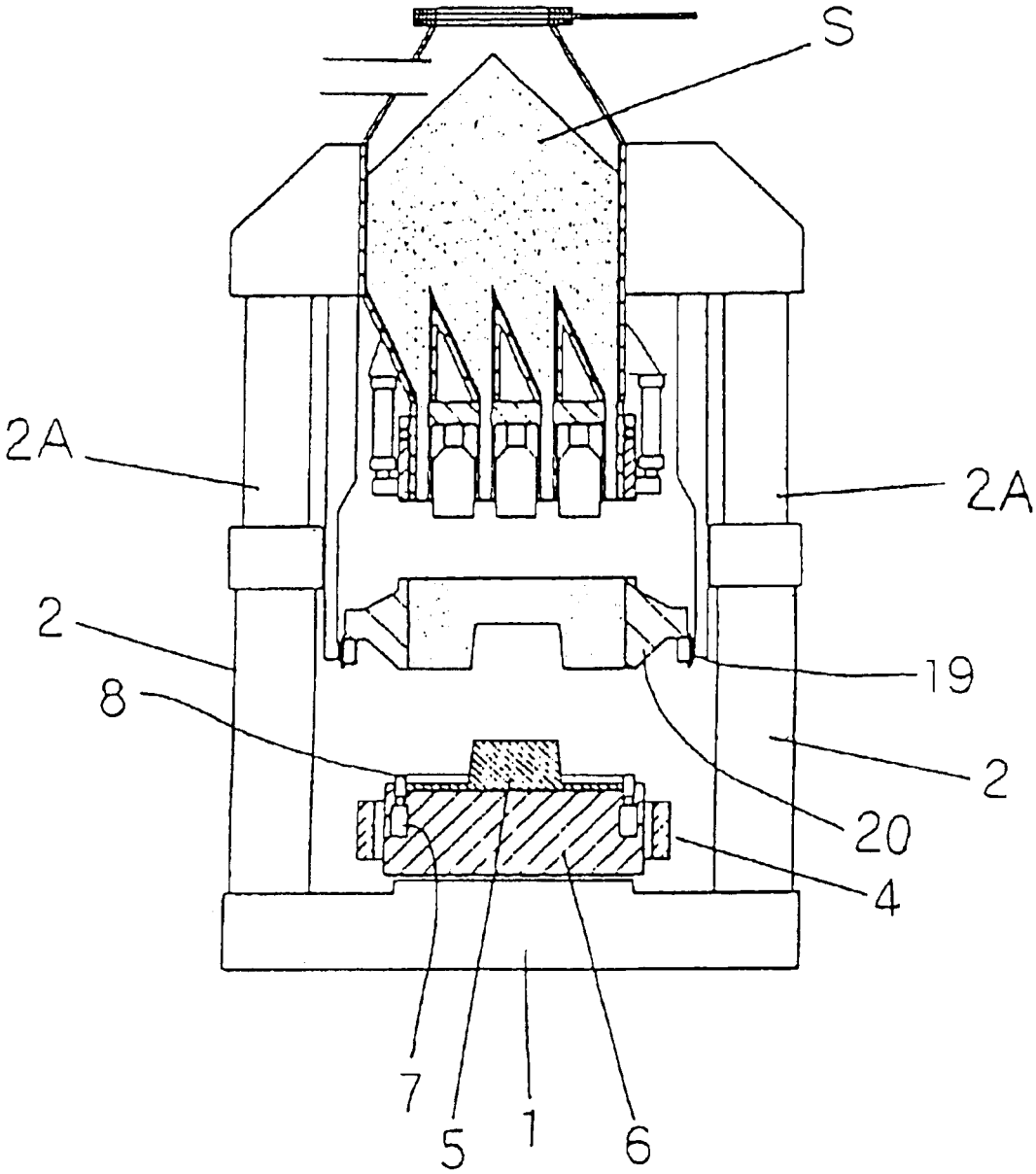
FIG. 7 is a schematic vertical section to show a state of the removal of a finished mold and the supply of foundry sand in the embodiment of FIG. 2.

The state as in FIG. 7 is achieved as follows: while the molding flask 20 is being compressed, via the mold removing frame 8, against the subsidiary flask 16 through the expansion operation of the cylinders 7,7, the flask-setting cylinders 2,2 are then inversely operated to remove the finished mold; at this time the subsidiary-flask cylinders 17,17 are moved up as a unit by being united with the molding flask 20 and the squeeze feet 13,13; the molding flask 20 that has molded a mold is supported and moved upward to be removed via the mold removing frame 8 by the cylinders 7,7 and at the same time as this the molding flask is moved up as a unit by being united with a subsidiary flask 16 and squeeze feet 13,13; and in the middle of the upward operation the molding flask 20 that has molded a mold is scooped up by the transport conveyor 19 to be completely separated from the pattern plate, and foundry sand S is supplied to the sand hopper as shown in FIG. 7. At this time the mold is removed in a very precise manner. This is because the finished mold is removed when it is raised a little from its stationary state, as well as the finished mold being removed when the piston rods 2A,2A of the flask-setting cylinders have been in their most contracted positions.

Figure 8:
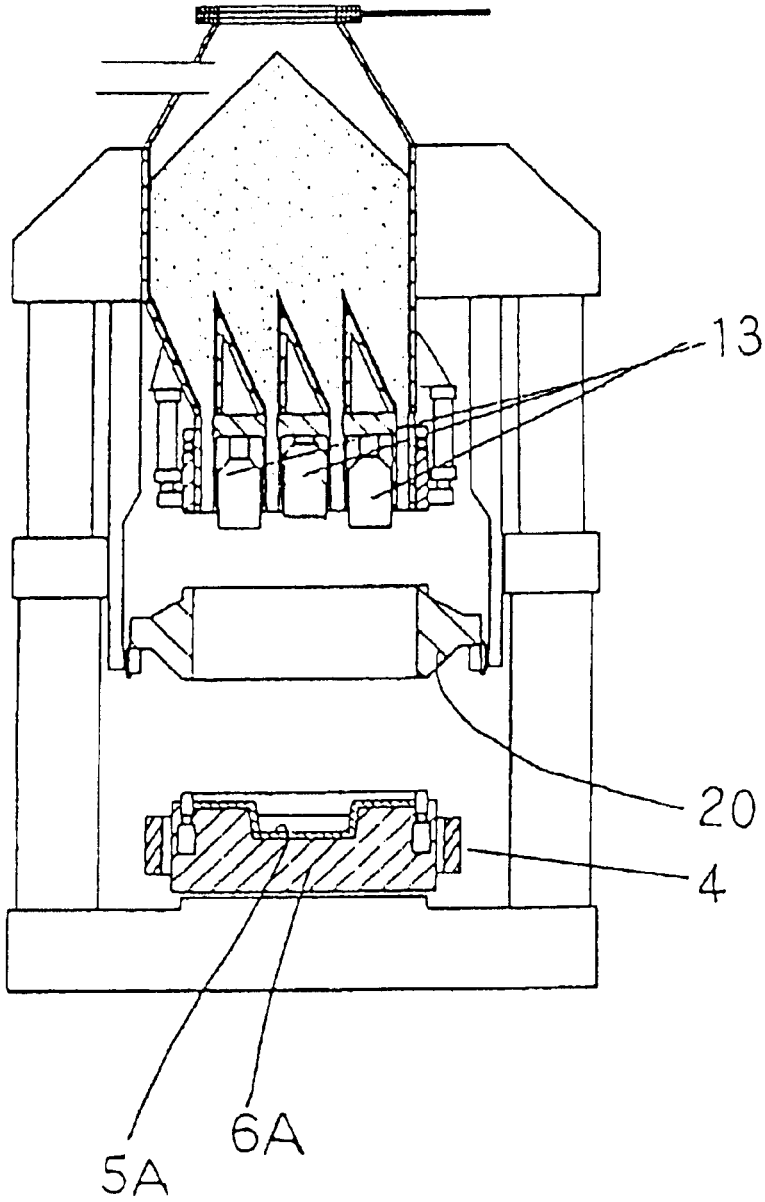
FIG. 8 is a schematic vertical section to show a state of the replacement of a pattern plate in the embodiment of FIG. 2.

Finally, the state as in FIG. 8 is achieved as follows: the molding flask 20, which has molded a mold, is then transported away via the transport conveyor 19; an empty molding flask 20 is transported in and at the same time as this the pattern replacing device 4 is operated by actuators (not shown) to replace the pattern plate 5 with a pattern plate 5A; and the segmented squeeze feet 13,13 are operated to form a concave/convex shape corresponding to the concave/convex shape of the pattern plate 5A, as shown in FIG. 8.

When the pattern plate 5,5A is to be replaced with another pattern plate, a pattern carrier 6,6A, on which the pattern plate 5,5A is placed, is transported out from the pattern replacing device 4 by pattern carrier transport means (not shown), and after the pattern plate 5,5A has been replaced with another pattern plate, the pattern carrier 6,6A, on which another pattern plate is placed, is transported to be set into the pattern replacing device 4.

Although in the embodiments of this invention it is described that low-pressure air is jetted from the lower periphery and the lower inside of the sand hopper 12, the low-pressure air may be jetted from another location in the sand hopper 12. Although the preparatory compression of foundry sand is not carried out, foundry sand may be preparatively compressed through fluid air compression by providing a rotary gate, or an opening for introducing compressed air, and the like. Further, although it is described that numbers of air jetting chambers 11,11 communicate with a changeover valve (not shown), this may be changed such that a changeover valve is provided for each individual air jetting chamber to separately adjust the jetted low-pressure air.

Although in the embodiments of this invention it is described that the flask-removing cylinders 7,7A that operate as an actuator to move the flask-removing frame are built in the pattern carrier 6,6A, the flask-removing cylinders may be not so limited, but they may be built in the pattern replacing device 4. Further, another embodiment of a pattern carrier 25, as shown in FIG. 10, comprises a portion for placing a pattern plate 22, a plurality of guide pins 24 that slide up and down on the outside of the pattern plate 22 and that horizontally push up the bottom surface of the flask-shaped mold removing frame 23, flask-removing cylinders 26 that operate as a plurality of actuators for moving up and down the plurality of guide pins 24 so as to have them penetrate a space portion in the bottom surface of the pattern carrier 25, and a molding base 27 on which the flask-removing cylinders 26 are mounted such that ends of the flask-removing cylinders 26 do not reach the lower surface of the pattern carrier 25 when they are most contracted.

It is a matter of course that there should be no interference between the pattern replacing device 28 and the flask-removing cylinders 26 when the former is being transferred. Some means (for example, fall preventing means, not shown, that connects the plurality of guide pins 24 to the flask-removing frame 23) should be provided to prevent the plurality of guide pins 24 from falling. Further, it is considered that in the pattern carrier 25 a clamping member (not shown) and a clamping device to clamp the clamping member are provided, and the pattern carrier 25 is pressed against the molding base 27 by puffing the clamping member through the clamping device.

Figure 10:
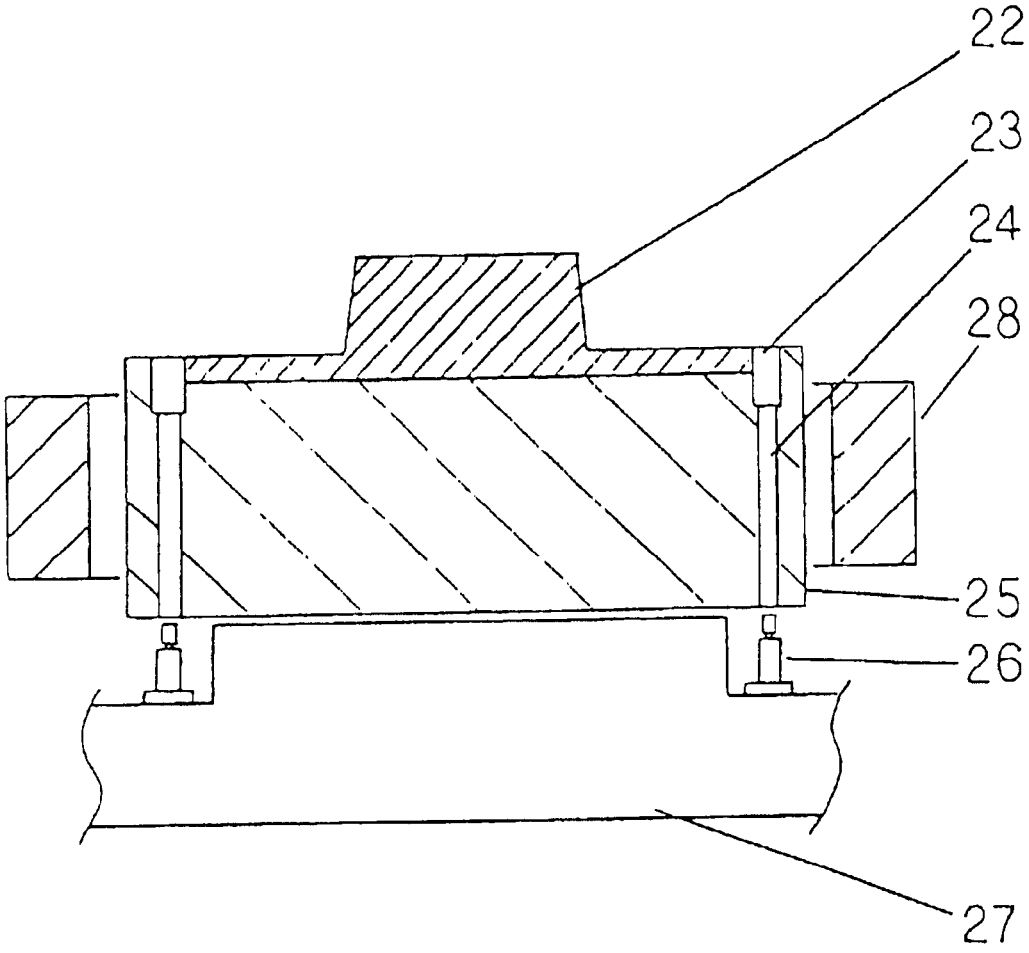
FIG. 10 is an enlarged vertical section to show another embodiment of the pattern plate carrier of this invention.

In the case of the embodiment shown in FIG. 10, since the flask-removing cylinders 26 can also be used for upper and lower pattern carriers at both sides of the pattern-replacing device 26, the cylinders can be installed in just the molding base. Thus, the pattern carrier 25 will not become complicated, and when a working fluid is used, the constitution of its circuit may be simple and the power of the working fluid can be small.

Figure 11:
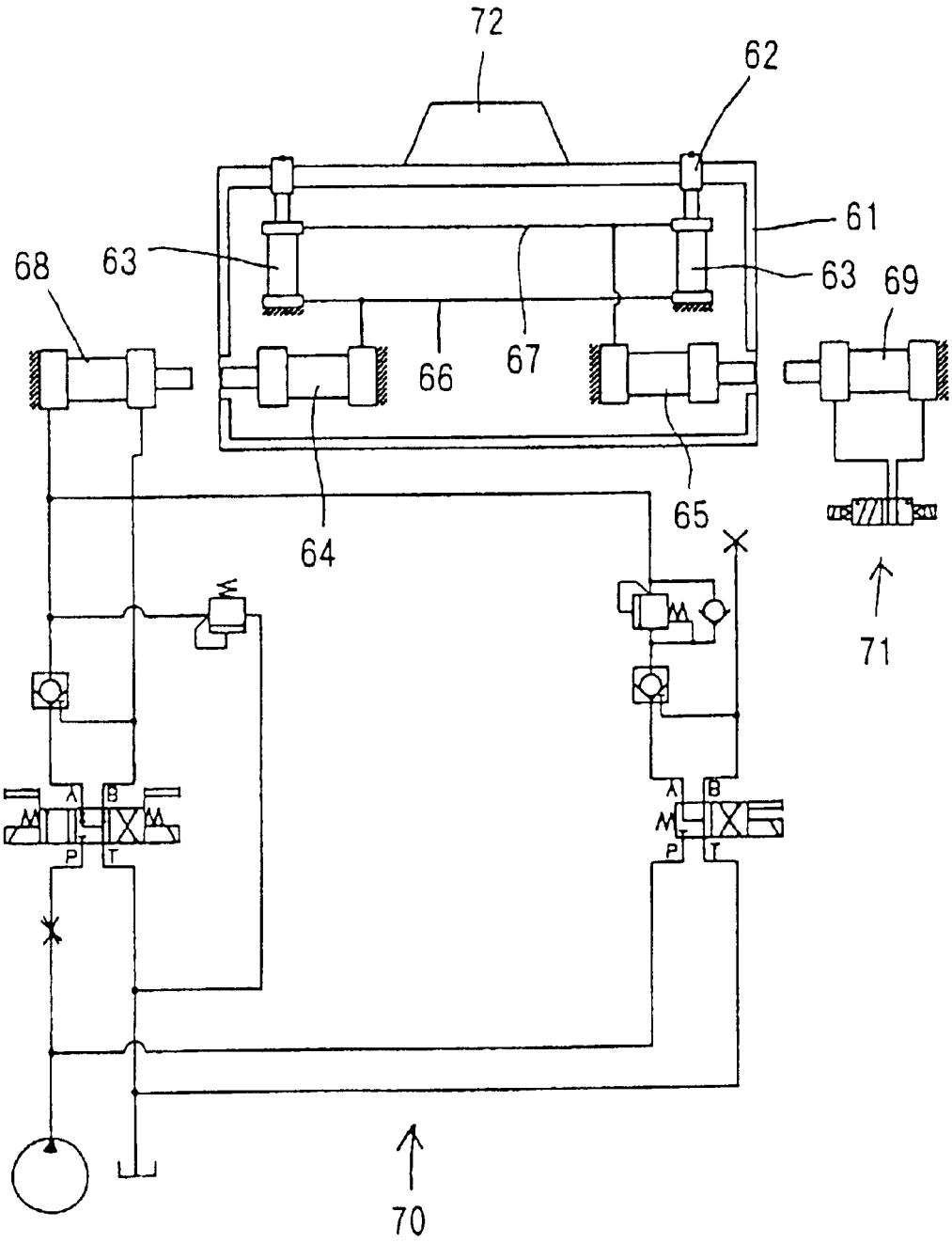
FIG. 11 is a schematic elevation to show an embodiment of the pattern plate carrier of this invention.

Referring to FIG. 11, we now explain an embodiment of the pattern carrier apparatus used for the molding machine of this invention. An auxiliary flask 62 is disposed movably up and down in the upper end part of a box-shaped pattern plate carrier 61. The auxiliary flask 62 is mounted on the piston rods of a plurality of upward oil cylinders. 63,63 mounted on the carrier 61 such that the auxiliary flask 62 can be moved up and down through the expansion/contraction of the oil cylinders 63,63.

The rear lid side of the plurality of oil cylinders 63,63 is communicatively connected to the rear lid side of a first special oil cylinder 64 mounted on the left side of the pattern plate carrier 61 via piping 66, and the front lid side of the plurality of oil cylinders 63,63 is communicatively connected to the rear lid side of a second special oil cylinder 65 mounted on the right side of the pattern plate carrier 61 via piping 67. The expansion and contraction of the plurality of oil cylinders 63,63 is generated such that the first and second special oil cylinders 64 and 65 are interlocked to be alternately contracted and expanded so as to alternately supply oil to and discharge oil from, the rear lid side and front lid side, respectively.

The first special oil cylinder 64 is contracted by the expansion of an oil cylinder 68 that is separately and fixedly disposed in a given place outside the pattern plate carrier 61. The second special oil cylinder 65 is contracted by the expansion of an air cylinder 69 that is separately and fixedly disposed in a given location outside the pattern plate carrier 61 Further, the oil cylinder 68 is expanded/contracted by an oil supply circuit 70 and the air cylinder is expanded/contracted by an air supply circuit 71 On the upper surface of the pattern plate carrier 61 a pattern plate is mounted.

In the thus constituted embodiment the auxiliary flask is moved up such that the pattern plate carrier 61 and the auxiliary flask 62 and the like are moved to a given position; the first special oil cylinder 64 and the second special oil cylinder 65 are made to correspond to the oil cylinder 68 and air cylinder 69, respectively; and the oil cylinder 68 is expanded and simultaneously the first special oil cylinder 64 is contracted, thereby fluid being supplied to the rear lid side of the oil cylinders 63,63 to cause them to expand so as to move up the auxiliary flask 62. Foundry sand is then blown into a molding space defined by squeeze feet (not shown), a molding flask (not shown), the auxiliary flask 62, and the pattern plate 72 so that the foundry sand thrown thereinto is compressed to be molded.

After the completion of the molding, the oil cylinder 68 is contracted and simultaneously the air cylinder 69 is expanded, and further, the first special oil cylinder 64 is expanded and simultaneously the second special oil cylinder 65 is contracted. Thereby fluid is supplied to the front lid side of the oil cylinders 63,63 and simultaneously fluid is discharged from the rear lid side of the cylinders 63,63 to make them contract so as to move down the auxiliary flask 62.

EFFECTS OF INVENTION

In accordance with the first embodiment of this invention, without the need to install large scale oil cylinders for lifting a pattern plate such as one requiring a pit, almost all the foundry sand in a molding space defined by a pattern plate and molding flask can be surely compressed into a mold having a desired hardness.

In accordance with the second embodiment of this invention, wherein a two step squeeze compression and an increase in the accuracy of removing a flask have been achieved, since the generation of spilled sand and chips of sand is greatly reduced, the molding space can be quantitatively and effectively filled with foundry sand, and since foundry sand is squeezed in correspondence to the concave/convex shape of a pattern plate, a homogenous mold can be molded. Further, since the power of the working fluid and the consumption of compressed air can be reduced, a reduction in cost is realized by saving energy.

In accordance with the pattern carrier of this invention, with the adoption of a flask-removing frame the body of the molding machine is simplified, and since flask-removing cylinders can also be used for both the upper and lower pattern carrier installed in both ends of the pattern replacing device, the simple structure of this invention enables the number of actuators to be halved, to save the power of working fluid.

In accordance with the embodiment of the improved pattern plate carrier of this invention, since the pattern plate carrier with an auxiliary flask can be compact, and since the time and labor for the attachment/detachment of piping can be reduced, the pattern plate carrier with an auxiliary flask can be accurately and movably installed.

As is clear from the above descriptions, the pattern plate carrier molding machine of this invention has various, excellent practical effects.

What we claim is:

1. A pattern carrier for a flask molding machine comprising a mount on which a pattern plate is mounted and a flask-shaped, molding flask-removing frame adapted to make contact with a lower end of a molding flask of a flask molding machine and moveable up and down around said pattern plate for removing a finished mold.

2. The pattern carrier for a flask molding machine of claim 1, wherein said flask-shaped, molding flask-removing frame is moved up and down by actuators built into said pattern carrier or by a device for replacing the pattern plate.

3. A pattern carrier comprising a mount on which a pattern plate is mounted, a flask-shaped frame disposed movably up and down around said pattern plate for removing a finished mold, a plurality of guide pins for moving said flask-shaped frame up in a parallel manner, and a plurality of actuators mounted on a molding base, wherein said actuators pass through a space in said pattern carrier so as to move said plurality of guide pins up and down and are mounted so as to have their ends not touch a lower surface of the pattern carrier in their most contracted states.

4. The pattern carrier of claim 2 or 3, wherein said actuators are cylinders operated by an operating fluid.

5. The pattern carrier of claim 2 or 3, wherein said actuators are electric cylinders.

6. A pattern plate carrier for carrying a pattern plate, wherein the pattern plate carrier has an auxiliary flask on which a pattern plate is mounted moveable up and down, comprising a plurality of upward moveable cylinders mounted on said pattern plate carrier to move said auxiliary flask, at least two oil cylinders mounted on said pattern plate carrier for supplying a fluid with the upward cylinders by being alternately contracted, and at least two cylinders disposed separately outside said pattern plate carrier, and constituted such that the mutual expansion of said at least two cylinders causes said respective oil cylinders to alternately contact.

* * * * *